US005259558A

United States Patent [19]

Smith et al.

[11] Patent Number: 5,259,558

[45] Date of Patent: Nov. 9, 1993

[54] INDEXING AIR CAP

[75] Inventors: Rowland C. Smith, Wimborne; Anthony J. Bate, Winton, both of United Kingdom

[73] Assignee: ITW Limited, Berkshire, United Kingdom

[21] Appl. No.: 689,895

[22] PCT Filed: Feb. 5, 1991

[86] PCT No.: PCT/GB91/00167

§ 371 Date: Jun. 13, 1991

§ 102(e) Date: Jun. 13, 1991

[87] PCT Pub. No.: WO91/11265

PCT Pub. Date: Aug. 8, 1991

[30] Foreign Application Priority Data

Feb. 5, 1990 [GB] United Kingdom ..... 9002526

[51] Int. Cl.[5] ..... B05B 15/08

[52] U.S. Cl. ..... 239/600; 403/376

[58] Field of Search ..... 239/290-300, 239/600, 588, 526, 587.1, 587.5, 587.6; 403/372, 376; 277/207 A, 235 B, 227

[56] References Cited

U.S. PATENT DOCUMENTS

| | | | |
|---|---|---|---|
| 1,586,010 | 5/1926 | Shelburne | 239/301 |
| 1,717,086 | 6/1929 | Binks . | |
| 1,819,116 | 8/1931 | Preble | 239/290 |
| 1,873,625 | 8/1932 | Munz | 239/301 |
| 1,907,031 | 5/1933 | Anderson . | |
| 1,962,911 | 6/1934 | Roselund | 239/301 |
| 2,269,057 | 1/1942 | Jenkins . | |
| 2,520,375 | 8/1950 | Roe | 403/372 X |
| 3,195,819 | 7/1965 | Watanabe | 239/290 X |
| 3,606,162 | 8/1970 | Lehmann | 901/43 X |
| 3,930,656 | 1/1976 | Jelinek | 277/207 A X |
| 4,171,096 | 10/1979 | Welsh et al. | 239/301 X |
| 4,899,938 | 1/1990 | Havrilla, Jr. | 239/294 |

FOREIGN PATENT DOCUMENTS

| | | | |
|---|---|---|---|
| 2702191 | 8/1978 | Fed. Rep. of Germany | 239/240 |
| 2527480 | 12/1983 | France . | |

*Primary Examiner*—Andres Kashnikow
*Assistant Examiner*—Kevin P. Weldon
*Attorney, Agent, or Firm*—MacMillan, Sobanski & Todd

[57] ABSTRACT

An indexing air cap is described comprising an air cap (8), mounted to be adjustably rotatable on the spraygun body (1), a baffle (10) having a recess (12) and a seal (11) of low density plastics material, such as polyethylene, being located between the baffle and the spraygun body. The baffle (10) and the seal (11) having a plurality of holes (16) passing axially through them and being circumferentially spaced from each other. A pin (17) passing through an aligned set of the holes (16) in the baffle and seal to connect with a blind hole (18) in and lock them to the spraygun body (1). Rotation of the air cap through a predetermined angle of 90° indexes the air spray cap to control the radial position and targeting of the spray pattern of the fluid being sprayed. The spray gun body has a mounting aperture which receives a mounting stud. Bevelled washers on the mounting stud are compressed to expand into engagement with the mounting aperture for locking the gun body to the mounting stud.

4 Claims, 2 Drawing Sheets

FIG. 2.
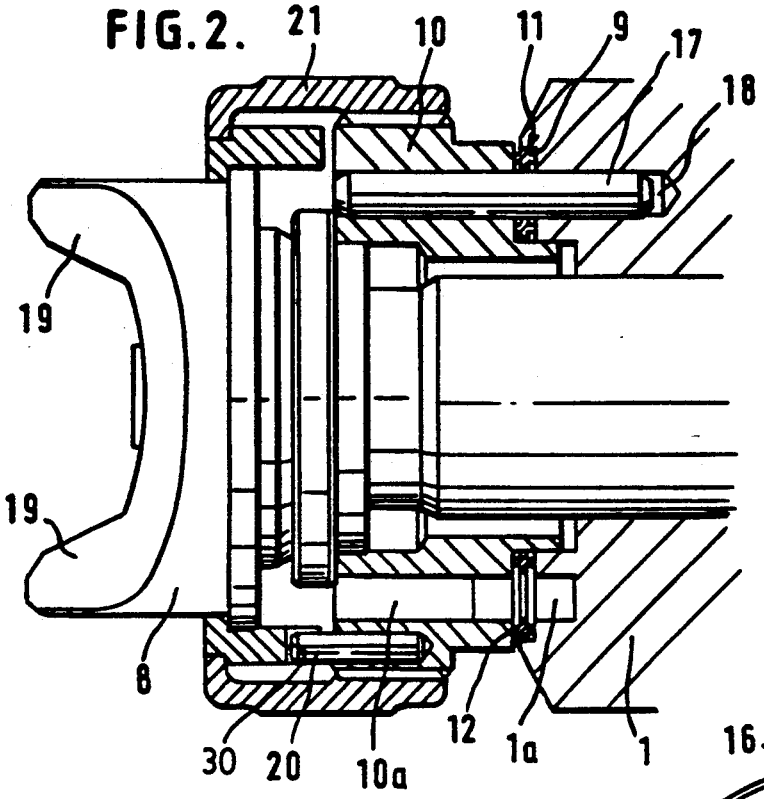
FIG. 4.
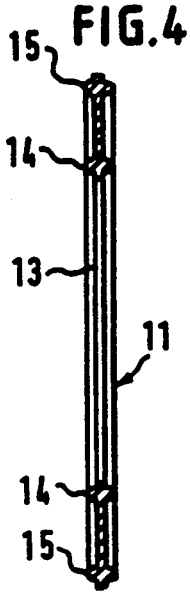
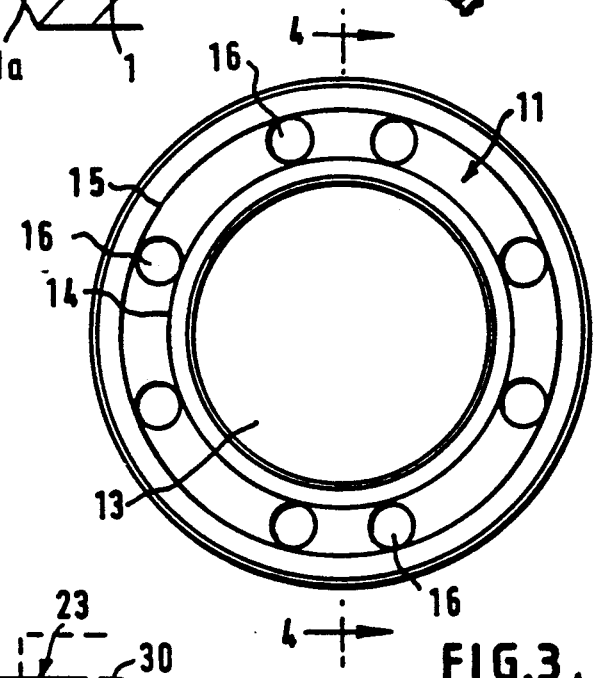
FIG. 3.
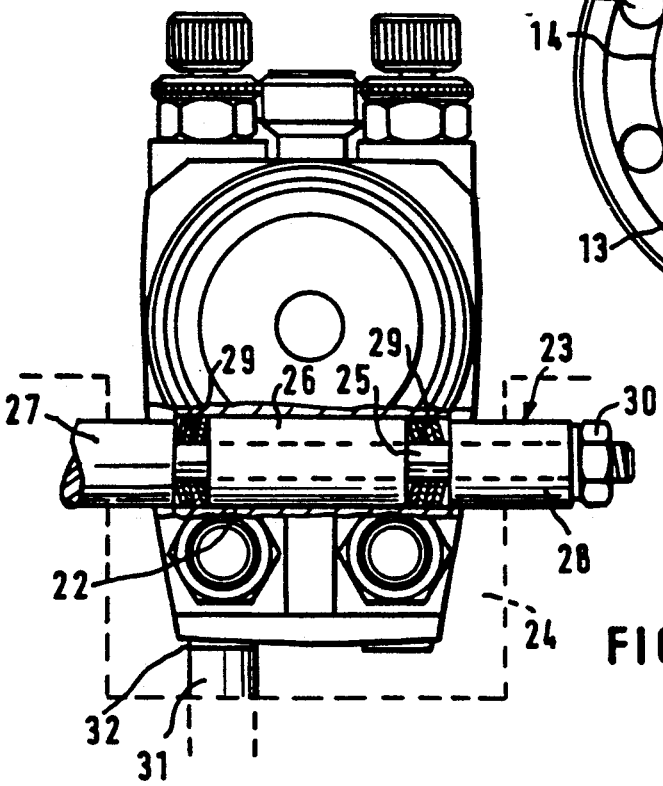
FIG. 5.

INDEXING AIR CAP

TECHNICAL FIELD

This invention relates to an indexing air cap for automatic sprayguns.

BACKGROUND ART

Automatic sprayguns are increasingly being used in spray booths to spray e.g. paint on the bodywork of motor vehicles. The accuracy of mounting the spraygun on a robot has become critical as the center of the area to be sprayed must be located within 2 mm to 5 mm of the center axis of the spraygun nozzle when repositioning the spraygun.

Existing automatic sprayguns have the disadvantage that when the air cap is removed, replacement can cause the center of the spray pattern to diverge from its previous center point resulting in an uneven disposition of material known as "banding" when the gun follows the predetermined movement path of a machine or robot.

Manually operated sprayguns do not have the same disadvantage as the positioning of the spraygun is made by the eye of an experienced operator which prevents this problem.

An aim of the present invention is to overcome or mitigate the above mentioned disadvantage of automatic sprayguns.

DISCLOSURE OF INVENTION

According to one aspect of the present invention there is provided an automatic spraygun comprising an air cap adjustably secured on the sprayhead of the automatic spraygun, a baffle located on the body of the spraygun and a seal of low density plastics material located between the baffle and the body, wherein the air cap is located in angular increments relative to the spraygun ensuring replacement within accurately predetermined limits.

Preferably the air cap is located in angular increments of 90°.

In a preferred construction the seal is made of polyethylene and has inner and outer sealing beads.

According to a second aspect of the present invention there is provided an automatic spraygun with a centrally located aperture passing laterally of the longitudinal axis of the spraygun, a mounting stud passing through the aperture and extending from each side of the spraygun to engage apertures in a mounting fixture, wherein the mounting stud has at least two collars located on a screw-threaded bolt, a plurality of beveled washers being interposed between the collars such that tightening of the screw-threaded bolt expands the washers within the aperture to adjustably secure the mounting stud to the spraygun.

Conveniently, there are three collars on the screw threaded bolt with two sets of beveled washers between two outer collars and a central collar.

Embodiments of the present invention will now be described, by way of example only, with reference to the accompanying drawings, in which:

BRIEF DESCRIPTION OF THE DRAWINGS

FIG. 2 is a fragmentary axial cross-section of an air cap and indexing assembly on an enlarged scale;

FIG. 3 is a front elevation of the seal;

FIG. 4 is an axial section of the seal taken along in line 4—4 in FIG. 3; and

FIG. 5 is a section taken along the line 5—5 of FIG. 1 with the addition of the mounting stud and mounting fixture.

BEST MODE FOR CARRYING OUT THE INVENTION

Figure 1:
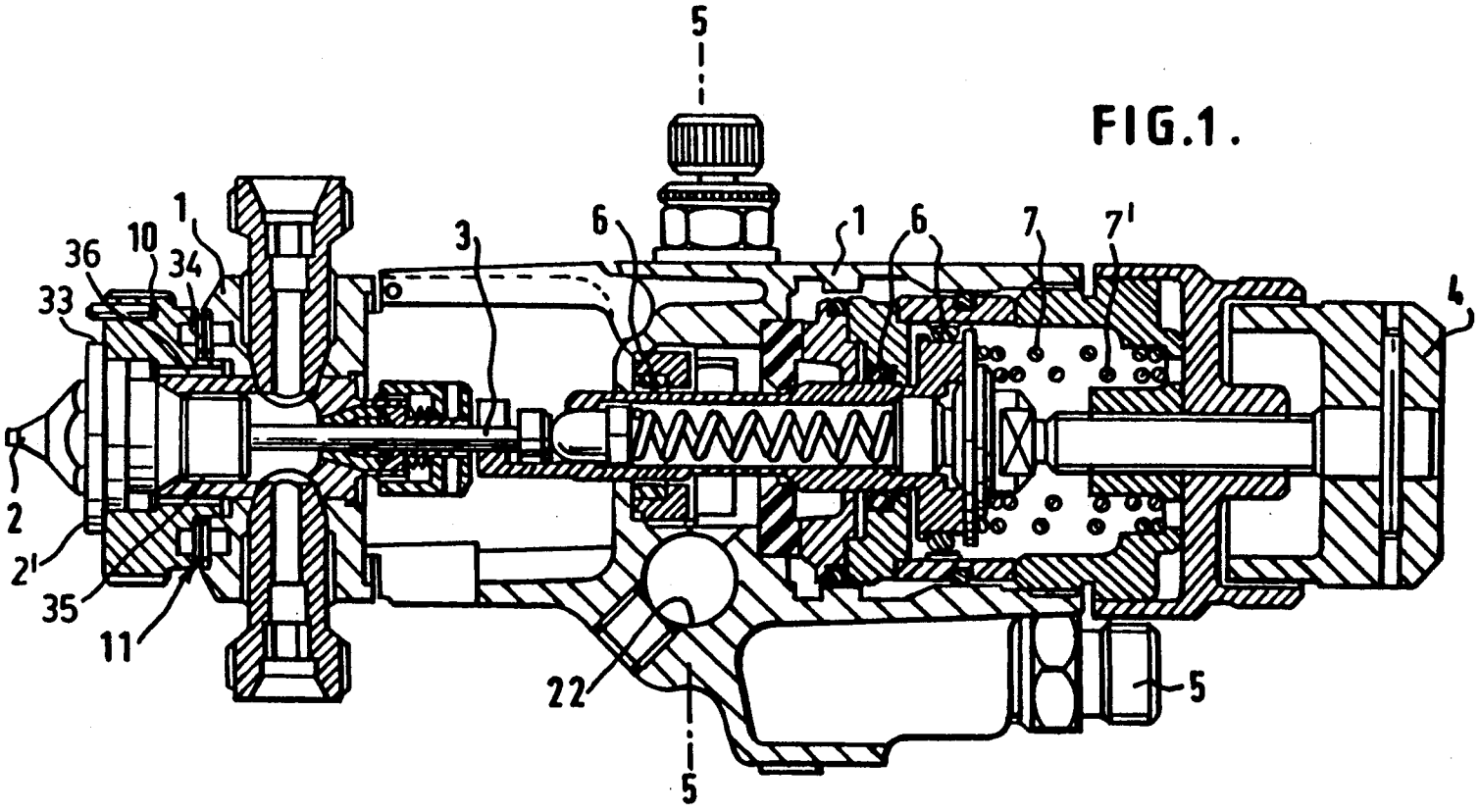
FIG. 1 is a longitudinal cross-section of an automatic spraygun according to the present invention, but having the air cap removed.

The spraygun illustrated in FIG. 1 comprises a body 1 within which are mounted conventional mechanisms as described in our co-pending Application No. 8914130.3 to control the flow of air to a nozzle 2. The fluid to be sprayed via the nozzle is metered by a needle 3 the fine adjustment of which is controlled by the control knob 4. Air is supplied to the gun via the inlet 5 passing along a series of passages within the gun body to an air cap 8 (shown in FIG. 2). The control mechanism operating the needle 3 is sealed from the air flow path by 'Shamban' double delta seals 6 and is urged to the forward position by stainless steel helical springs 7 and 7'.

The air cap indexing assembly according to the present invention is shown on an enlarged scale in FIGS. 2 to 4 and comprises an air cap 8 (see FIG. 2) mounted to rotate on the spraygun body 1 having a recess 9.

A baffle 10 made of metal axially aligned and nonrotatable on the body 1 with the interposition of a seal 11 mounted on the baffle 10 and seated in a recess 12 in the rear face of the baffle and in the recess 9 of the body. The seal is shown in detail in FIGS. 3 and 4 and comprises a central aperture 13 and inner and outer beads 14 and 15. Radially arranged between the beads 14 and 15 and circumferentially spaced around the seal 11 are a plurality of holes 16 which are so spaced from one another to allow air to transfer evenly from annular chamber 1*a* in the sprayhead to annular chamber 10*a* in the baffle 10.

A pin 17 is located in one of the aligned holes in the baffle and seal where it locates in a blind hole 18 in the gun body 1. This pin locates the baffle 10 and seal 11 relative to one another and fixes them in the desired arcuate position relative to the gun body. A fluid tip 2' secures the baffle 10 to the gun body 1. The fluid tip 2' has an enlarged diameter flange 33 which clamps the baffle 10 to an end 34 of the gun body 1 when a threaded end 35 on the fluid tip 2' either engages the body 1 or engages an insert 36 which is secured to the body 1.

The air cap 8 is mounted on the baffle 10 and has horn shaped projections 19 through which air is supplied to shape the fluid to be sprayed. The orientation of the air cap 8 controls the position of the pattern of the spray area of the fluid. The air cap is located to the baffle 10 by a pin 20 and is secured to the baffle 10 by a screw-threaded collar 21. The pin 20 is secured to the baffle 10 and selectively engages one of a plurality of precisely located recesses 30 spaced around the air cap 8. This location allows the air cap to be indexed at 90° intervals or other angular increments producing a repeatable and a precise targeting of the centre of the spray pattern within 2 mm to 5 mm of the previous setting.

As the automatic sprayguns are operated remotely on robot mechanisms, the spraygun has to be critically adjusted relative to the surface to be sprayed. To facilitate this adjustment, the spraygun body 1 has an aperture 22 (see FIGS. 1 and 5) passing transversely of the longitudinal axis of the spraygun about the centre of the spraygun. A mounting stud 23 is adjustably secured in the aperture 22 and extends from each side of the gun body where it is located in a mounting fixture 24, shown in dotted line in FIG. 5. The mounting stud 23 comprises a central screw-threaded bolt 25 with three spaced collars, a central collar 26 and two outer collars 27 and 28. The collar 27 may be an integral portion of the mounting stud 23, as shown.

Located on the bolt 25 are two pluralities of beveled or Belleville washers 29 and 29'. The stack of washers 29 is positioned between the collar 26 and the collar or stud portion 27 and the stack of washers 29' is positioned between the central collar 26 and the outer collar 28. Preferably, the stack of washers 29 faces in one direction and the stack of washers 29' faces in an opposite direction, as shown, to increase the force holding the spray gun on the stud 23. By tightening-up a nut 30 against the outer collars, the beveled washers are expanded in diameter to adjustably lock the mounting stud 23 within the aperture 22. The beveled washers 29 are often referred to as Belleville springs or washers in the United States. The automatic spraygun can thus be precisely adjusted about the axis of the mounting stud to position the direction of the spray nozzle. The mounting fixture has a pin 31 which locates in a hole 32 drilled in the bottom of the spraygun body 1 to precisely locate the lateral position of the spraygun relative to the mounting fixture 24.

We claim:

1. In an automatic spray gun having a body, a baffle, a fluid tip securing said baffle to said body, an annular polyethylene seal located between said baffle and said body, said seal having a central aperture extending between two faces and having inner and outer radial beads on each of said faces, an air cap releasably secured to said baffle, means for selectivley indexing said air cap at 90° increments relative to said body in a plurality of discrete angular positions to ensure replacement of said air cap within accurately predetermined limits, said indexing means including a first pin extending between said baffle and said body, said first pin preventing rotation of said baffle relative to said body, and a second pin extending between said baffle and a recess in said air cap to prevent rotation of said air cap relative to said baffle, said air cap having at least two recesses for receiving said second pin when said air cap is indexed in at least two different positions relative to said body, a mounting stud, a mounting aperture in said gun body receiving said mounting stud, and means for securing said gun body to said mounting stud in a desired lateral and rotational position including pin means for laterally positioning said body on said mounting stud, a plurality of beveled washers mounted on said stud and received by said mounting aperture, and means for compressing and expanding said beveled washers to engage said mounting aperture.

2. The improvement to an automatic spray gun, as set forth in claim 1, wherein sad stud includes a first stud portion, a threaded bolt secured to said first stud portion, first and second collars positioned on said bolt, a first plurality of said beveled washers positioned on said bolt between said first stud portion and said first collar, a second plurality of said beveled washers positioned on said bolt between said first and second collars, and wherein said compressing means includes means for urging said first and second collars towards said first stud portion to compress said beveled washers.

3. In an automatic spray gun having a body, the improvement comprising a mounting stud, a mounting aperture in said gun body receiving said mounting stud, and means for securing said gun body to said stud in a desired lateral and rotational position including pin means for laterally positioning said body on said mounting stud, a plurality of beveled washers mounted on said stud and received by said mounting aperture, said stud including a first stud portion, a threaded bolt secured to said first stud portion, first and second collars positioned on said bolt, a first plurality of said beveled washers positioned on said bolt between said first stud portion and said first collar, a second plurality of said beveled washers positioned on said bolt between said first and second collars, and means for compressing and expanding said beveled washers to engage said mounting aperture including means for urging said first and second collars towards said first stud portion to compress said beveled washers.

4. An improved automatic spray gun, as set forth in claim 3, wherein said first plurality of beveled washers are stacked on said bolt to face in one direction and wherein said second plurality of beveled washers are stacked on said bolt to face in a direction opposite said one direction.

* * * * *